US007374465B2

(12) United States Patent
Tanaka

(10) Patent No.: US 7,374,465 B2
(45) Date of Patent: May 20, 2008

(54) CONNECTOR

(75) Inventor: Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/598,289

(22) Filed: Nov. 13, 2006

(65) Prior Publication Data

US 2007/0111599 A1 May 17, 2007

(30) Foreign Application Priority Data

Nov. 15, 2005 (JP) ..... 2005-330102
Nov. 17, 2005 (JP) ..... 2005-332749

(51) Int. Cl.
*H01R 13/11* (2006.01)

(52) U.S. Cl. ..... 439/852; 439/595

(58) Field of Classification Search ..... 432/595, 432/851–852

See application file for complete search history.

(56) References Cited

U.S. PATENT DOCUMENTS

| | | | | |
|---|---|---|---|---|
| 4,696,530 A | | 9/1987 | Vandame | |
| 5,593,328 A | * | 1/1997 | Okada et al. | 439/851 |
| 5,630,738 A | * | 5/1997 | Ito et al. | 439/852 |
| 5,643,018 A | | 7/1997 | Sakai et al. | |
| 5,735,717 A | * | 4/1998 | Nabeshima | 439/851 |
| 6,152,788 A | | 11/2000 | Hata et al. | |
| 6,227,915 B1 | * | 5/2001 | Sakatani et al. | 439/852 |
| 6,527,601 B2 | * | 3/2003 | Chen | 439/852 |
| 6,547,608 B2 | * | 4/2003 | Sato et al. | 439/852 |
| 6,558,208 B2 | * | 5/2003 | Suzuki | 439/878 |
| 6,629,865 B2 | * | 10/2003 | Bungo | 439/852 |
| 7,090,545 B2 | * | 8/2006 | Morikawa | 439/852 |

FOREIGN PATENT DOCUMENTS

| | | |
|---|---|---|
| EP | 1 215 764 | 6/2002 |
| EP | 1 635 426 | 3/2006 |
| GB | 2 010 602 | 6/1979 |
| JP | 2000-357555 | 12/2000 |

* cited by examiner

*Primary Examiner*—Briggitte R. Hammond
*Assistant Examiner*—Larisa Tsukerman
(74) *Attorney, Agent, or Firm*—Gerald E. Hespos; Anthony J. Casella

(57) ABSTRACT

A connector has a housing (1) with a cavity (2) for receiving a terminal fitting (3). The terminal fitting (3) has a tubular main portion (6) and a locking hole (12) is formed in the main portion (6) for receiving locking projection (5B) of a lock (5). A tongue (14) extends from the front end of the main portion (6) and is folded back into the main portion (6). The front end of the locking projection (5B) is located before an extending end (14C) of the tongue (14) and the rear end thereof is located behind the extending end (14C) of the tongue (14). Accordingly, the locking projection (5B) is long at a position where a front end surface (5C) of the locking projection (5B) receives a shear force from a front edge (12A) of the locking hole (12), thereby enlarging a sectional area against the shear force.

10 Claims, 15 Drawing Sheets

CONNECTOR

BACKGROUND OF THE INVENTION

1. Field of the Invention

The invention relates to a connector.

2. Description of the Related Art

Japanese Unexamined Patent Publication No. 2000-357555 discloses a connector with a housing having a cavity that penetrates the housing in forward and backward directions. The connector also includes a terminal fitting that can be inserted into the cavity. The terminal fitting has a tubular main portion with a bottom wall and a locking hole is formed in the bottom wall. A tongue extends from the front edge of the bottom wall and is folded back into the main portion. An extending end of the tongue is supported on the inner surface of the bottom wall behind the locking hole. Thus, the tongue is supported at two points. A lock projects into the cavity and has a locking projection. The locking projection enters the main portion and engages the front edge of the locking hole to prevent the terminal fitting from coming out backward from the cavity.

The above-described tongue is premised on a two-point support, and hence the extending end of the tongue is located behind the rear edge of the locking hole. As a result, a dimension of the locking hole in forward and backward directions is restricted. The amount that the locking projection can enter the locking hole also is restricted. Furthermore, a shear area of the locking projection is restricted. Thus, the lock may not exert a sufficient holding force to resist a rearward pulling force on the terminal fitting.

The present invention was developed in view of the above problem, and an object thereof is to provide a sufficient holding force for preventing a terminal fitting from coming out backward while miniaturizing the terminal fitting.

SUMMARY OF THE INVENTION

The invention relates to a connector with a housing that has at least one cavity that penetrates the housing in forward and backward directions. A lock is arranged in the cavity. The connector also includes at least one terminal fitting that can be accommodated in the cavity. The terminal fitting has a substantially tubular main portion with a bottom wall and a locking hole is formed in the bottom wall. The lock has a locking projection that enters the main portion through the locking hole and engages the opening edge of the locking hole. A resiliently deformable tongue extends back from the front edge of the bottom wall and is folded back into the main portion. The tongue has a contact point for contacting a male tab that is inserted into the main portion. The tongue also has an extending end that is behind the contact point and spaced inwardly from the locking projection. The front end of the locking projection is before the extending end of the tongue and the rear end of the locking projection is behind the extending end of the tongue. Accordingly, the locking projection has a maximally long dimension in forward and backward directions and has a large sectional area for resisting a shear force generated by the opening edge of the locking hole. Therefore, the terminal fitting can be miniaturized while still providing an enhanced holding force for preventing the terminal fitting from coming backward out of the cavity.

The extending end of the tongue preferably is supported in contact with at least one support at least when the male tab and the contact point are connected. The support is raised from the bottom wall and prevents interference between the locking projection and the tongue. Further, the tongue preferably is supported at the front edge and at the extending end. Therefore, a contact pressure with the male tab can be strengthened to improve contact reliability, as compared to a case where the tongue is supported only at one point.

The support preferably is formed by bending in an area of the main portion from the bottom wall to a side wall. Accordingly, the supporting surface can be provided easily and inexpensively.

Two supports preferably are provided and are spaced apart in the width direction. Thus, the tongue can be supported in a stable posture without being twisted.

The support preferably is a cantilever formed by bending a wall of the main portion in, and an opening left in the bottom wall by the bending preferably communicates with the locking hole. Accordingly, the support can be provided easily and inexpensively.

A supporting projection bulges out sideways from at least one of the opposite widthwise edges of the support, and a receiving portion is provided at a position on the side wall of the main portion facing the supporting projection. The supporting projection is engageable with the receiving portion. Accordingly, the tongue can be supported securely since the support has the supporting projection and the receiving portion engageable with this supporting projection is provided at the side wall.

The lock preferably comprises a base and a locking projection projects in a direction intersecting the forward and backward directions from the inner surface of the base.

The locking projection preferably is completely in a locking hole of the terminal fitting when the lock locks the terminal fitting. Thus, a reference plane between the base and the locking projection is substantially flush with a plane of opening of the locking hole when the lock engages the terminal fitting.

The tongue preferably is supported at two portions separated in longitudinal direction at least when the tongue is deformed.

At least one projection preferably bulges out from at least one widthwise lateral edge of the tongue. At least one preventing portion is formed at a side wall of the main portion facing the projection. The projection engages the preventing portion to prevent an excessive deformation of the tongue when the tongue is deformed within the resiliency limit thereof.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
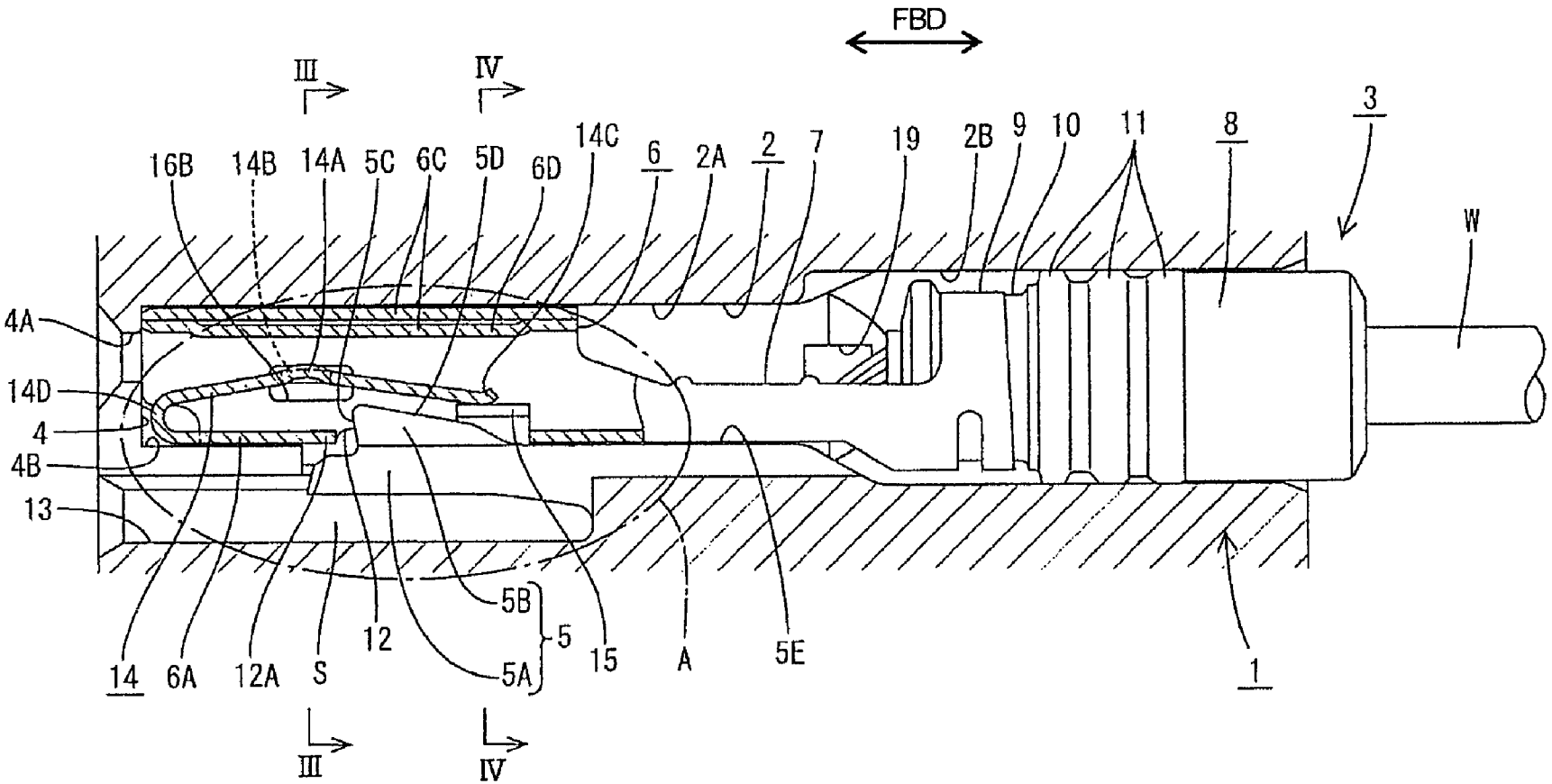
FIG. 1 is a longitudinal section showing a lock located in a main portion of a connector according to a first embodiment.
Figure 2:
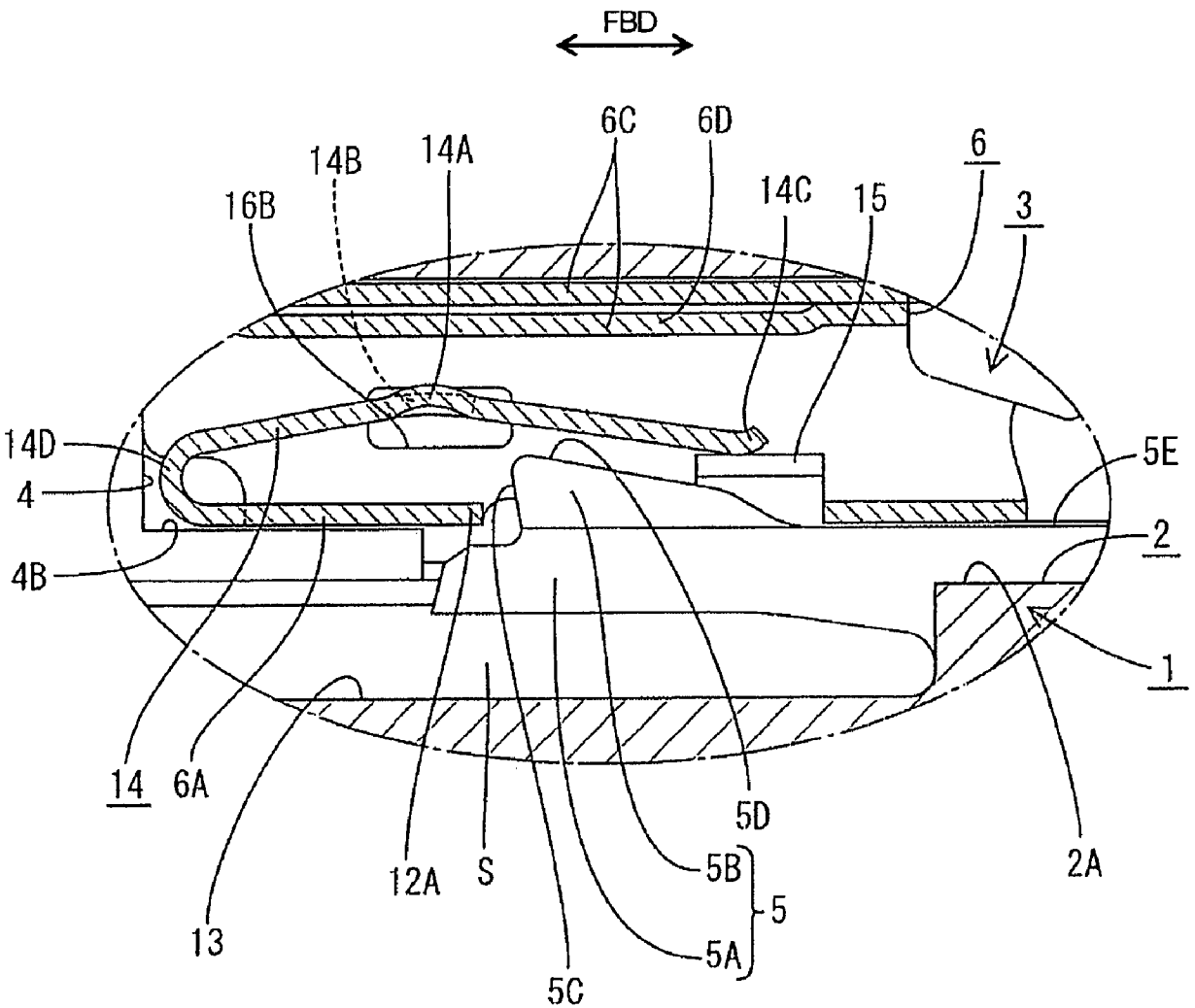
FIG. 2 is an enlarged view of a portion A in FIG. 1.
Figure 3:
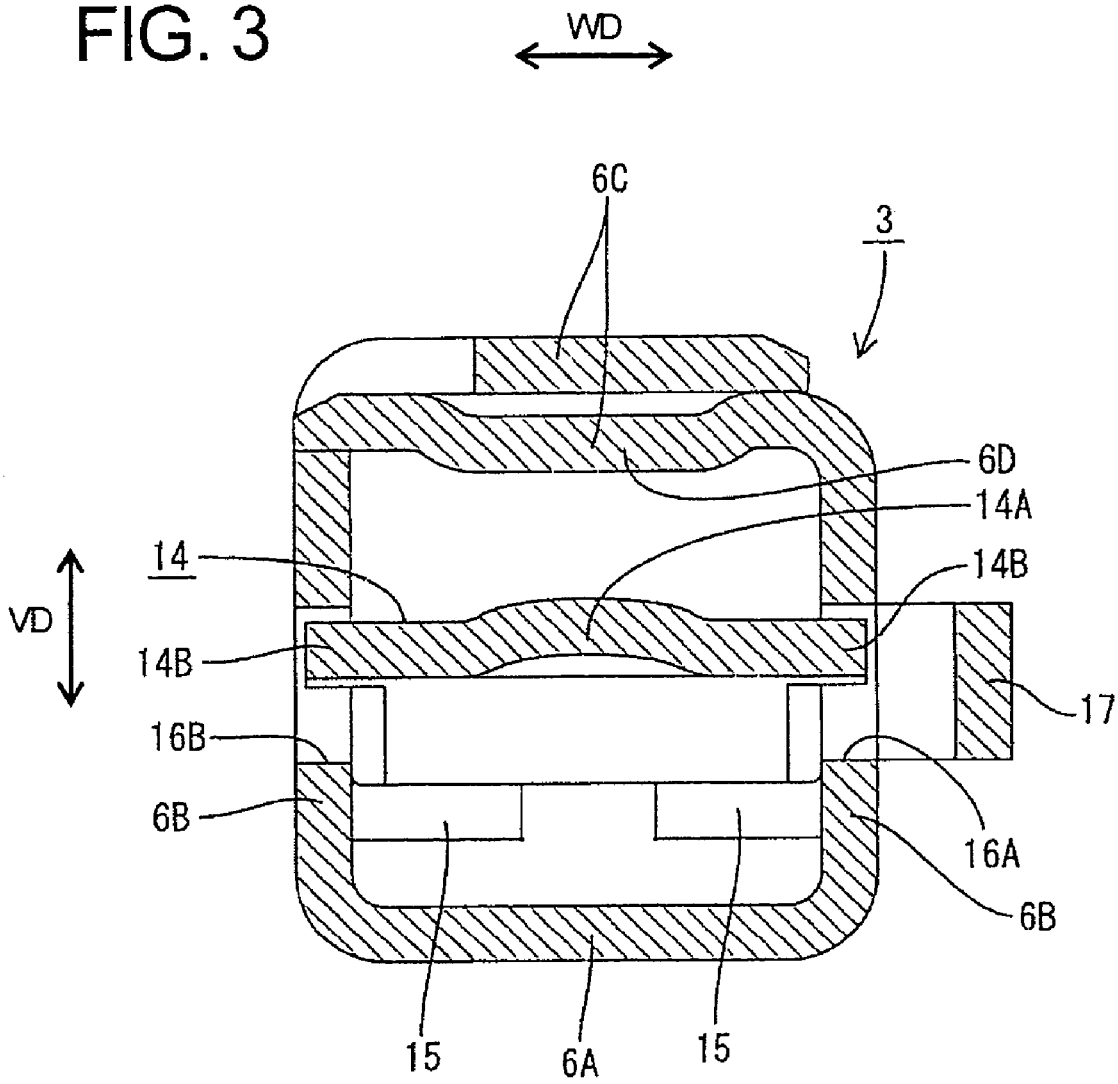
FIG. 3 is a section along III-III of FIG. 1.

A connector according to a first embodiment of the invention is described with reference to FIGS. 1 to 12. The connector includes a housing 1 with opposite front and rear ends that are spaced apart in forward and backward directions FBD. The front end of the housing 1 is the end that is to be connected with a mating connector. A cavity 2 penetrates through the housing 1 substantially in the forward and backward directions FBD. A terminal accommodating hole 2A is defined at a front portion of the cavity 2 and has a substantially rectangular cross section. A plug mounting hole 2B is defined at a rear portion of the cavity 2 and has a substantially round cross section. A terminal fitting 3 can be accommodated into the cavity 2 from behind as shown in FIG. 1. The terminal fitting 3 is stopped at its front position by a front wall 4 of the cavity 2, and is prevented from coming out backward by a lock 5 in the cavity 2. Further, a male-tab insertion hole 4A is formed in the front wall 4 for receiving a male tab (not shown) in a mating housing.

Figure 7:
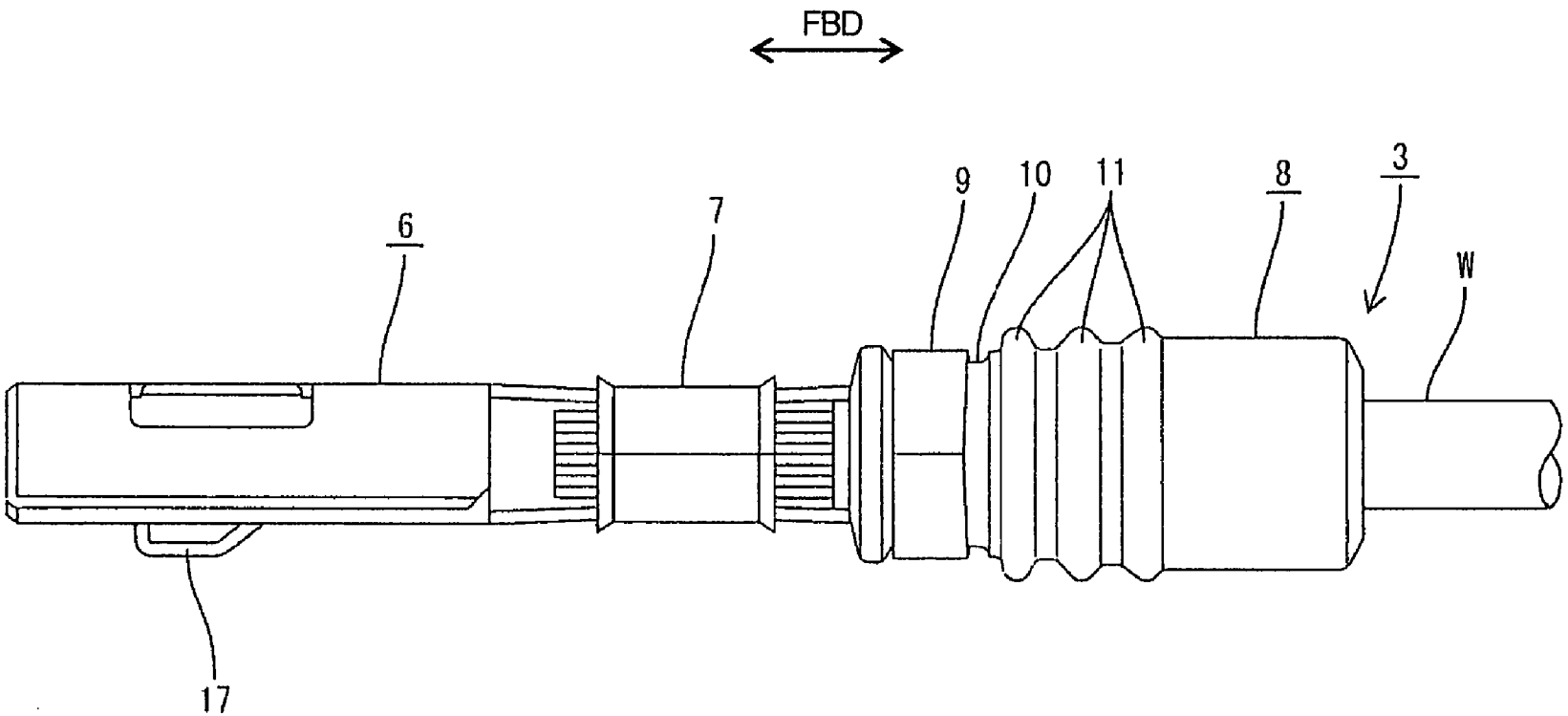
FIG. 7 is a plan view of a terminal fitting.

The terminal fitting 3 is formed by punching, cutting and/or press-forming a conductive metal sheet out and bending, embossing and/or folding the punched-out sheet. As shown in FIG. 7, the terminal fitting 3 has opposite front and rear ends that are spaced apart along forward and backward directions FBD, and a rectangular tubular main portion 6 is defined at the front end of the terminal fitting 3. A wire connection barrel 7 is behind the main portion 6 and is to be connected crimped, bent or folded into connection with a conductor of a wire W. An insulation barrel 9 is disposed behind the wire connection barrel 7 and is configured to be crimped, bent or folded into connection with a resilient plug 8 mounted over the insulation coating of the wire W. The main portion 6 is accommodated in the terminal accommodating hole 2A when the terminal fitting 3 is inserted into the cavity 2, and the plug 8 is accommodated in the plug mount hole 2B.

The plug 8 is made of a resilient material, such as silicon, and has a substantially cylindrical shape. A wire insertion hole penetrates the center of the plug 8 in substantially forward and backward directions FBD. An end of the wire W is inserted into the wire insertion hole, so that the plug 8 can be mounted on the insulation coating. A fastening portion 10 extends around the outer circumferential surface of the front end of the resilient plug 8, and the insulation barrel 9 is crimped, bent or folded around the fastening portion 10 to hold the rubber plug 8 in the terminal fitting 3. Lips 11 are formed circumferentially on the outer surface of the resilient plug 8 behind the fastening portion 10 and are spaced at specified intervals in forward and backward directions FBD. The lips 11 project radially out, and closely contact the inner circumferential surface of the resilient-plug mount hole 2B to prevent entry of fluids, such as water, to the inside through the plug mount hole 2B when the resilient plug 8 is inserted into the cavity 2.

Figure 12A:
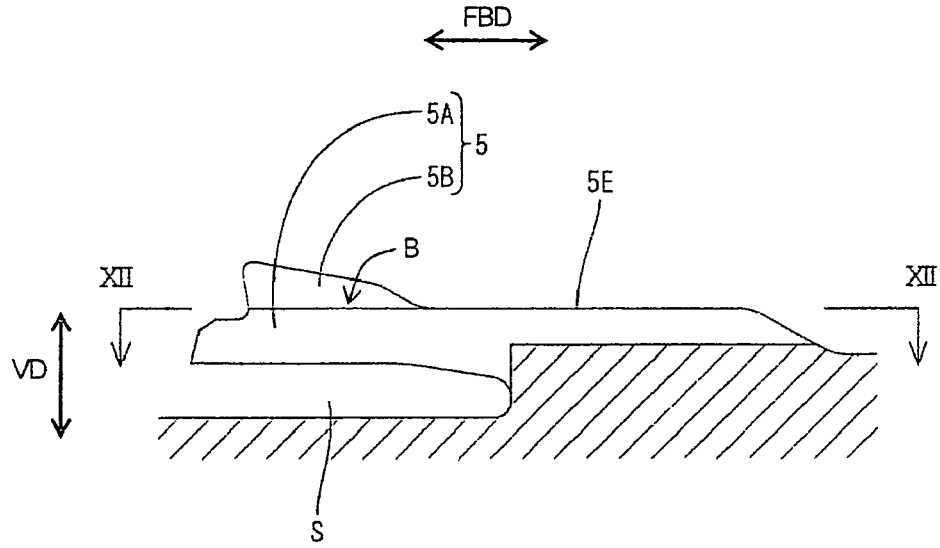
FIG. 12(A) is an enlarged view of a locking portion in FIG. 1
Figure 12B:
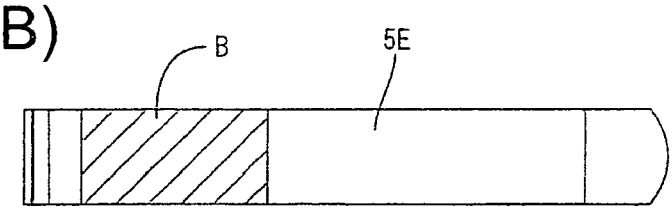
FIG. 12(B) is a section along XII-XII.

The lock 5 cantilevers forward from the bottom surface of the terminal accommodating hole 2A and is resiliently deformable towards a deformation space S below the lock 5. The lock 5 has a base 5A that extends forward from the back of the deformation space S and a locking projection 5B that projects up from the front end of the base 5A. The locking projection 5B is narrowed towards the top. FIG. 12(B) is a section along a horizontal reference plane B at a boundary between the base 5A and the locking projection 5B of FIG. 12(A). The normal vector of the reference plane B is substantially normal to the forward and backward directions FBD. A rib projects up from the bottom surface of the terminal accommodating hole 2A and extends rearwardly from the lock 5. The rib has the same width as the base 5A of the lock 5. A horizontal contact surface 5E extends continuously rearward from the locking projection 5B along the upper surface of the base 5A of the lock 5 and along the upper surface of the rib. The contact surface 5E is substantially coplanar with the reference plane B. A bottom surface 6A of the main portion 6 of the terminal fitting 3 slides on and is supported by the contact surface 5E when the terminal fitting 3 is being inserted into the terminal accommodating hole 2A. The terminal fitting 3 causes the lock 5 to deform into the deformation space S as the terminal fitting 3 is being inserted. However, the lock 3 restores resiliently when the locking projection 5B aligns with a locking hole 12 in the bottom surface 6*a* of the main portion 6 of the terminal fitting 3. The entire height and width of the locking projection 5B is in the locking hole 12 when the lock 5 is restored. Accordingly, the reference plane B substantially aligns with a plane of opening of the locking hole 12 when the lock 5 engages the terminal fitting 3 to define a large shear surface to resist a shear force exerted when the terminal fitting 3 is pulled back.

Figure 8:
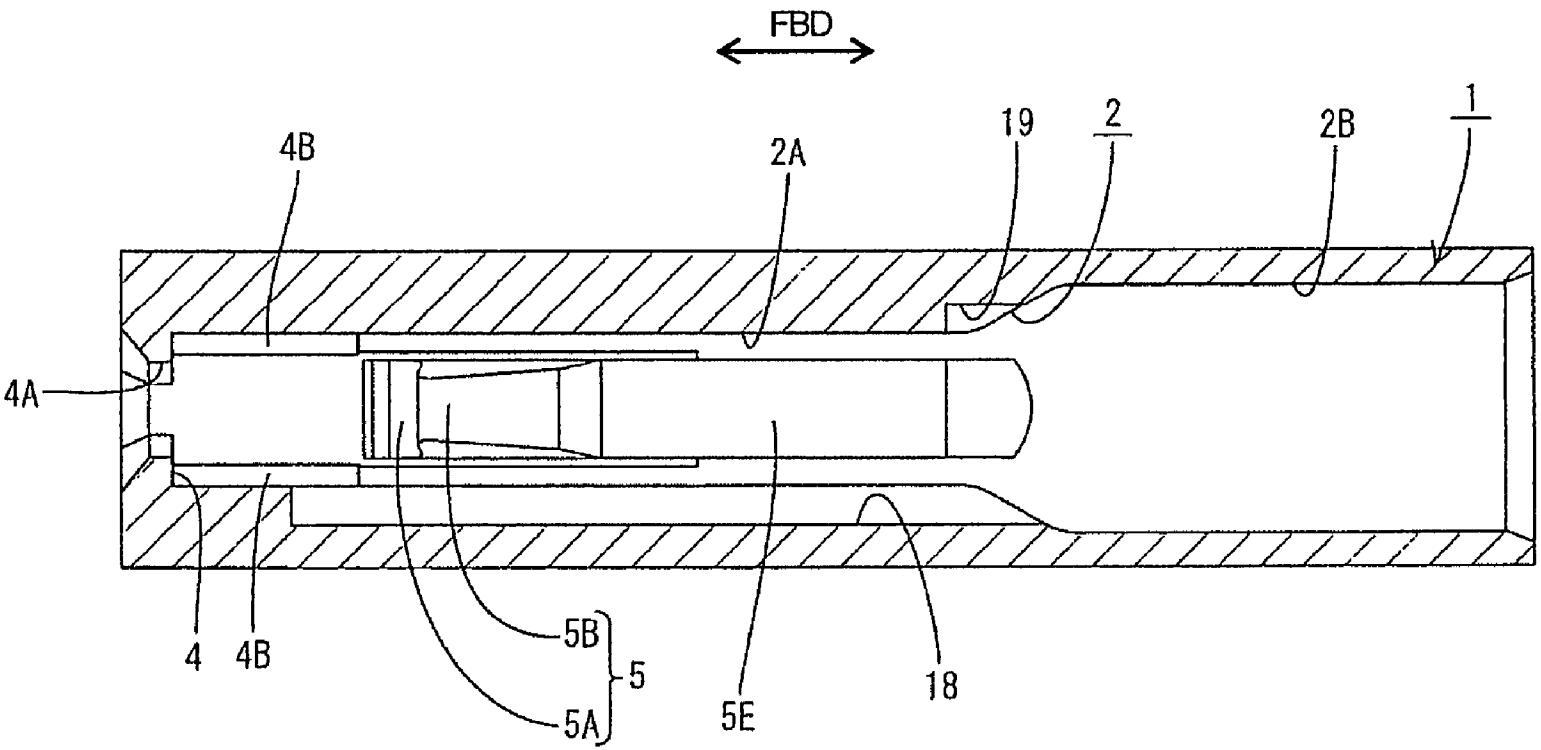
FIG. 8 is a side view in section showing a cavity viewed from above.
Figure 9:
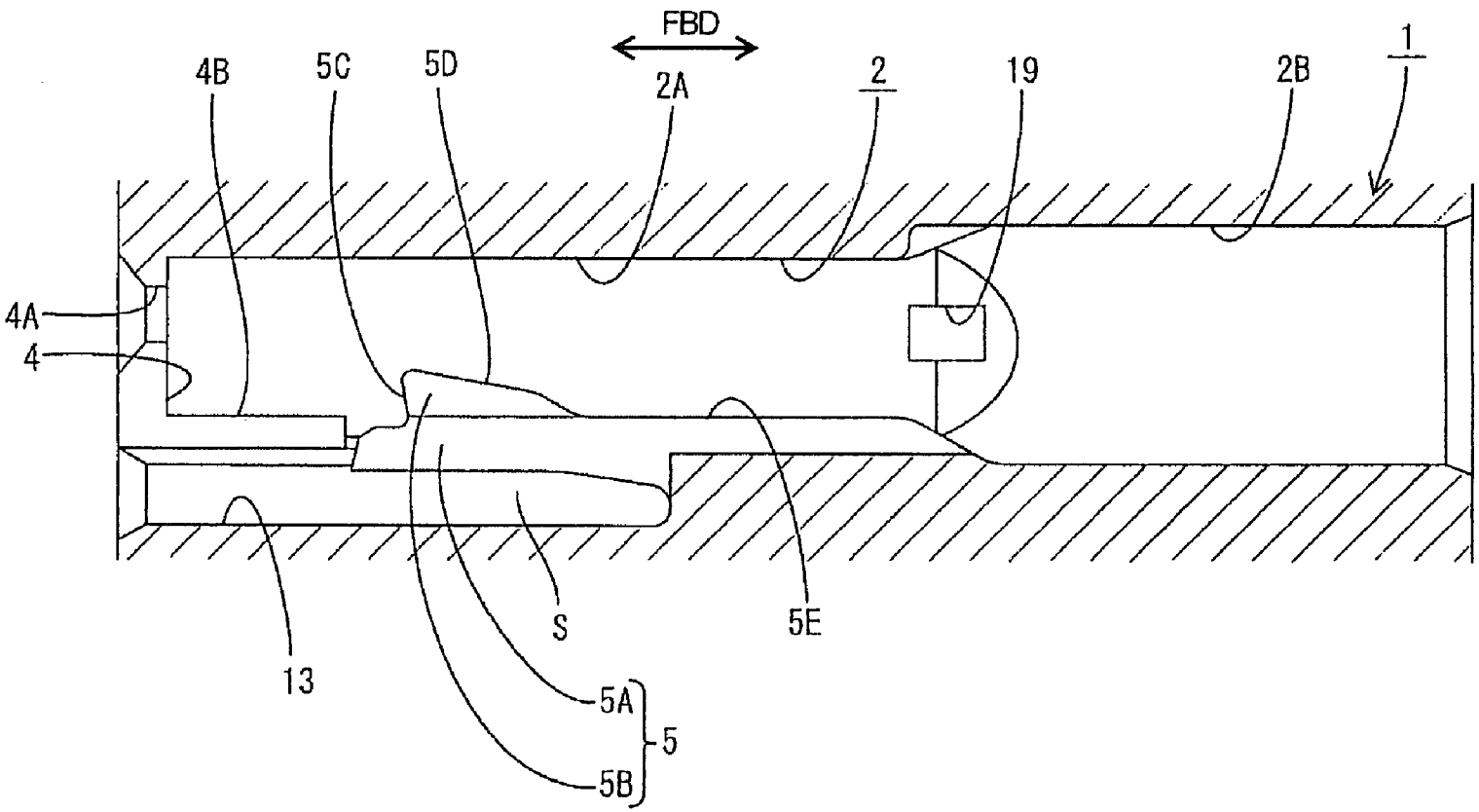
FIG. 9 is a longitudinal section showing the cavity viewed sideways.
Figure 10:
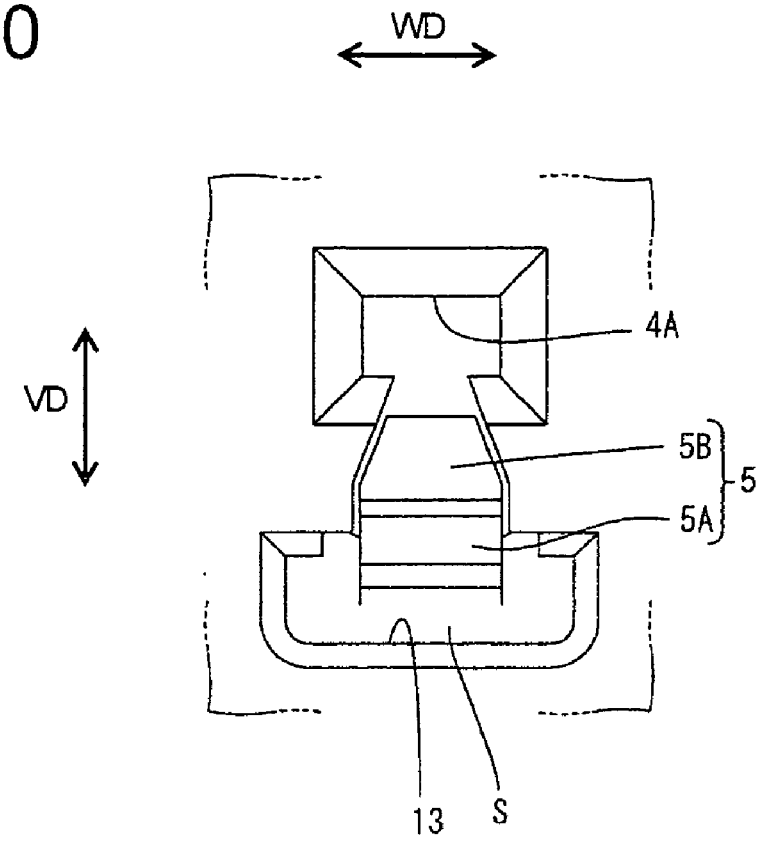
FIG. 10 is a partial front view of the connector.

The deformation space S opens in the front surface of the housing 1 to define a jig insertion hole 13 that communicates with the male tab insertion hole 4A. An unlocking jig (not shown) can be inserted through the jig insertion hole 13 to deform the lock 5 and to cancel the locked state of the terminal fitting 3. As shown in FIG. 8, the jig insertion hole 13 communicates with the inside of the terminal accommodating hole 2A. Thus, the lock 5 can be seen from the front, as shown in FIG. 10. Two supporting surfaces 4B bulge out from the opposite widthwise sides of the terminal accommodating hole 2A between the jig insertion hole 13 and the terminal accommodating hole 2A for preventing the terminal fitting 3 from falling down.

The main portion 6 of the terminal fitting 3 has a bottom wall 6A, opposite side walls 6B, 6B project up from the opposite side edges of the bottom wall 6A and an upper wall 6C that is opposed to the bottom wall 6A. The upper wall 6C is formed by bending upper parts of the opposite side walls 6B inward and placing bent parts one substantially over the other. The lower panel of the double-layered upper wall 6C is embossed inwardly to form a contact projection 6D that extends in the longitudinal direction, as shown in FIG. 1. On the other hand, a resiliently deformable tongue 14 is folded back at the front edge of the bottom wall 6A. Cuts are made in the opposite side surface portions 6B of the main body 6 at positions substantially corresponding to the opposite widthwise edges of a front edge 14D of the tongue 14, thereby exposing the front edge 14D to the outside.

The tongue 14 has an embossed section with a dome-shaped contact point 14A projecting up towards the contact projection 6D, as shown in FIG. 1. A distance between the contact projection 6D and the contact point 14A is set so that the male tab is sandwiched resiliently between the contact point 14A and the projection 6 upon insertion into the main portion 6 through the male tab insertion hole 4A. Further, two preventing pieces 14B bulge out at the opposite widthwise sides of the contact point 14A of the tongue 14. The rear extending end 14C of the tongue piece 14 is bent slightly up.

The locking hole 12 extends over substantially the entire width in the bottom surface portion 6A of the main portion 6. The locking projection 5B has a forwardly inclined overhanging or undercut front end surface 5C and a slanted surface 5D having a moderate downward inclination towards the back from the upper edge of the front end surface 5C. The front end surface 5C of the locking projection 5B engages the front edge 12A of the locking hole 12 when the lock 5 is inserted through the locking hole 12 and into the main portion 6 to prevent the terminal fitting 3 from coming out back in the withdrawal direction.

Figure 4:
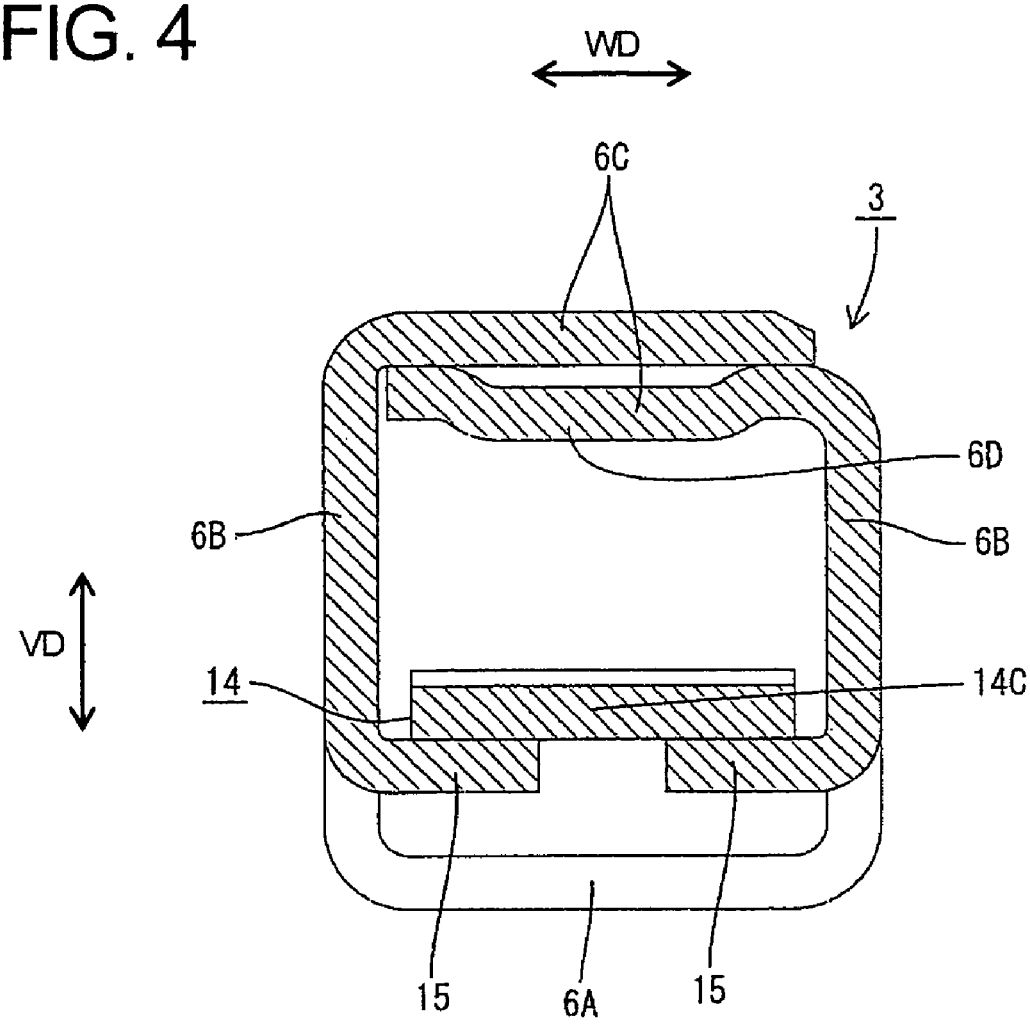
FIG. 4 is a section along IV-IV of FIG. 1.
Figure 5:
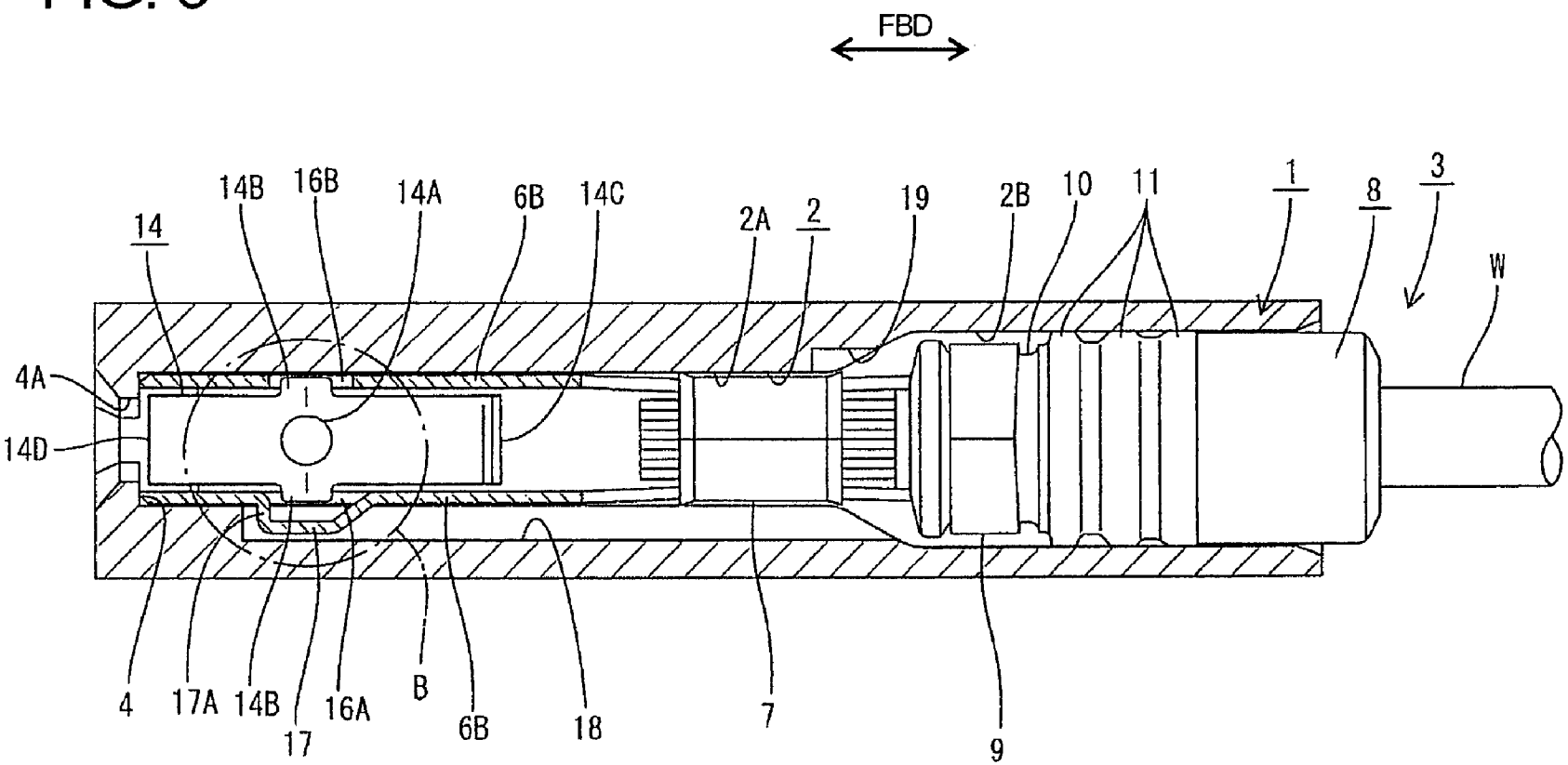
FIG. 5 is a side view in section showing a state where a preventing piece is located inside a stabilizer.
Figure 6:
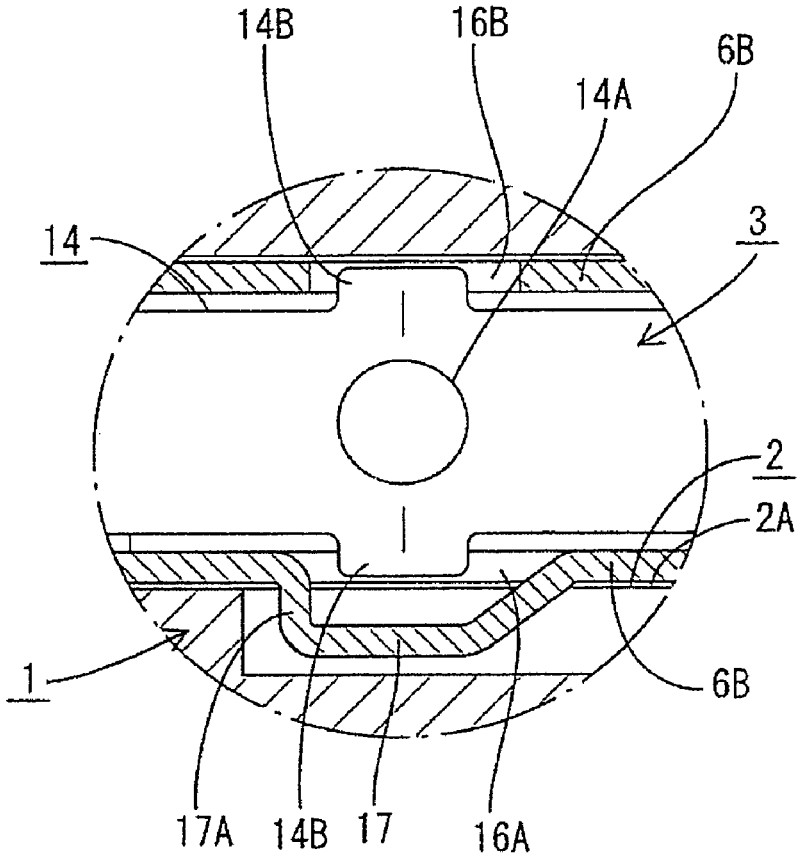
FIG. 6 is an enlarged view of a portion B in FIG. 5.

Supports 15 project from the opposite side walls 6B and raise the rear end of the locking hole 12 from the bottom wall 6A of the main portion 6. The supports 15 support the extending end 14C of the tongue 14 when the male tab is inserted, and engagement margins with the extending end 14C are formed by bending sections from the bottom wall 6A to the side walls 6B inward, as shown in FIG. 4. The extending end 14C contacts with the upper surfaces of the supports 15 of this embodiment even before the male tab is inserted. The length of the supports 15 in forward and backward directions FBD is set such that the extending end portion 14C is supported on the upper surfaces of the supports 15 until the male tab is inserted to a proper position. In other words, the tongue 14 is supported at two points, i.e. at the front edge 14D and at the extending end 14C. Therefore a contact pressure with the male tab can be strengthened to improve contact reliability as compared to a case where the tongue 14 is supported only at the front edge 14D.

The locking projection 5B engages the front edge 12A of the locking hole 12 and receives a shear force in forward and backward directions FBD when the terminal fitting 3 is pulled back in the withdrawal direction. A holding force against the backward withdrawal of the terminal fitting 3 is increased by extending a dimension of the locking projection 5B maximally in forward and backward directions FBD at a height where the shear force is received so that a sectional area against the shear force is enlarged. The locking projection 5B is formed so that the rear end of the slanted surface 5D aligns with the rear end of the opening edge of the locking hole 12. Additionally, the front surface 5C of the locking projection 5B can be before the extending end 14C of the tongue 14 and the rear end of the slant surface 5D of the locking projection 5B can be behind the extending end 14C of the tongue 14 by locating the extending end 14C of the tongue 14 more inwardly than the locking projection 5B. The supporting surfaces 15 are disposed to avoid interference between the slanted surface 5D and the tongue 14. However, the space between the slanted surface 5D of the locking projection 5B and the lower surfaces of the supporting surfaces 15 is minimized. It should be noted that a rear end of the slanted surface 5D is inclined to an extent that the lock 5 can be deformed resiliently into the deformation space S without deforming the front edge 14D of the tongue 14 when the terminal fitting 3 is inserted into the cavity 2 from behind.

Openings are formed in the side walls 6B of the main portion 6 facing the preventing pieces 14B of the tongue 14, and edges of these openings define preventing portions 16A and 16B. The preventing portions 16A, 16B engage the preventing pieces 14B to prevent excessive deformation of the tongue 14, but permit the tongue 14 to deform in the vertical direction VD within its resiliency limit. The second preventing portion 16B is at the left side in FIG. 3 and is formed by boring the left side wall 6B in FIG. 3. The first preventing portion 16A is at the right side in FIG. 3 and is formed by causing a part of the right side wall 6B in FIG. 3 to project out. Specifically, the first preventing portion 16A is formed by making two vertically spaced slits that are long in forward and backward directions FBD. An area between the slits then is embossed to form an outwardly projecting stabilizer 17 for preventing an erroneous insertion of the terminal fitting 3 and for stabilizing its insertion. In other words, the first preventing portion 16A is the edge of the opening made in the right side wall 6B upon forming the stabilizer 17, and the preventing piece 14B is engageable with this opening edge. Thus, the erroneous insertion of the terminal fitting 3 and the excessive deformation of the tongue 14 are prevented at the same position, thereby increasing locations where other functional parts are formed and increasing a degree of freedom in design.

Figure 11:
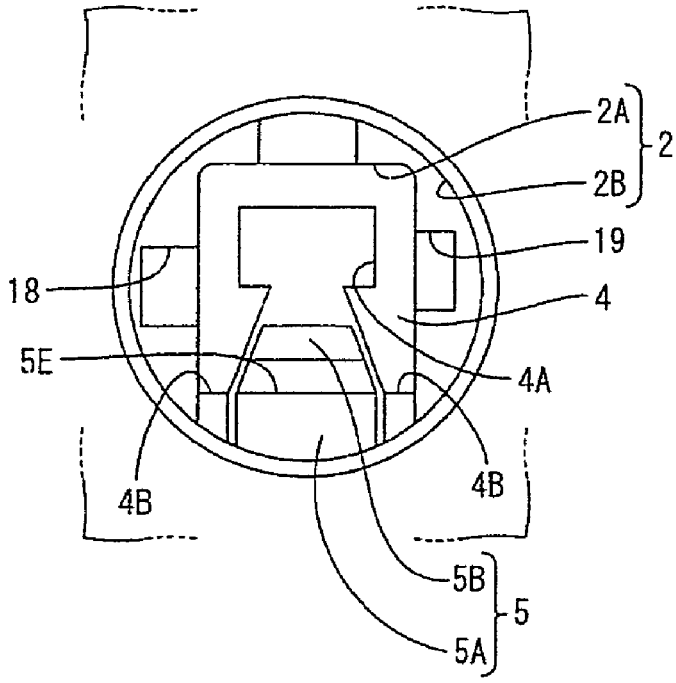
FIG. 11 is a partial rear view of the connector.

As shown in FIG. 7, a front end surface 17A of the stabilizer 17 projects substantially normal to the side wall 6B. As shown in FIG. 11, the inner wall of the cavity 2 is recessed to form a guiding recess 18 at a position facing the stabilizer 17 when the terminal fitting 3 is inserted into the cavity 2 from behind. The guiding recess 18 extends in forward and backward directions FBD from the rear end of the terminal accommodating hole 2A to a position near the front end thereof in the cavity 2, as shown in FIG. 8. On the other hand, a detecting recess 19 is formed at a position substantially symmetrical to the guiding recess 18 with respect to the widthwise center in the cavity 2 by partly cutting a portion near the rear end of the terminal accommodating hole 2A. Thus, when the terminal fitting 3 is inserted into the cavity 2 in a proper posture, the guiding recess 18 receives the stabilizer 17 to permit insertion of the terminal fitting 3. However, the front end surface 17A of the stabilizer 17 contacts the front end surface of the detecting recess 19, if the terminal fitting 3 is in an improper orientation (e. g. upside down), thereby preventing the stabilizer 17 from entering at a position near the rear end of the terminal accommodating hole 2A. Thus, an erroneous orientation of the terminal fitting 3 can be detected.

The terminal fitting 3 is inserted into the cavity 2 from behind. At this time, the guiding recess 18 receives the stabilizer 17 when the terminal fitting 3 is in the proper posture to permit the insertion of the terminal fitting 3 into the cavity 2. However, the front end surface 17A of the stabilizer 17 contacts the front end surface of the detecting recess 19 if the terminal fitting 3 is in the improper orientation (such as upside down) to prevent the erroneous insertion of the terminal fitting 3 and to detect the improper orientation. The front edge 14D of the tongue 14 moves onto the locking projection 5B while the bottom surface portion 6A of the main portion 6 of the terminal fitting 3 slides on the sliding-contact surface 5E of the lock 5. Thus, the lock 5 deforms into the deformation space S. The terminal fitting 3 is pushed further so that the main portion 6 moves forward in the terminal accommodating hole 2A while the front edge 14D slides on the slanted surface 5D. The front end of the main portion 6 is stopped at its front end position by contact with the front wall 4. The lock 5 then restores resiliently and enters the main portion 6 through the locking hole 12. As a result, the front end surface 5C engages the front edge 12A of the locking hole 12 to prevent the terminal fitting 3 from coming out backward.

There are cases where the front end surface 5C of the locking projection 5B receives a shear force from the front edge 12A of the locking hole 12. For example, the wire W may be pulled strongly back in the withdrawal direction with the terminal fitting 3 accommodated in the cavity 2. In such a case, the reference plane B resists shearing since the locking projection 5B is entirely in the locking hole 12. The reference plane B is extended by positioning the extending end 14C up and in as compared to the prior art. Thus, the force for holding the terminal fitting 3 against a rearward pulling force is strengthened. In this respect, the supports 15 keep the extending end 14C of the tongue 14 at a position up and in from the bottom wall 6A of the main portion 6 so that the rear end of the locking projection 5B can be behind the extending end 14C of the tongue 14. Thus, the holding force to prevent the terminal fitting 3 from coming out backward can be enhanced while the terminal fitting 3 is miniaturized. The supports 15 prevent interference between the tongue 14 and the locking projection 5B. Thus, the inclination of the slanted surface 5D can be set to minimize the space between the slanted surface 5D of the locking projection 5B and the bottom of the supports 15. Further, the tongue 14 can be supported at two points, namely the front edge 14D and the extending end 14C. Therefore, connection reliability can be improved by strengthening the contact pressure with the male tab as compared to a case where the tongue 14 is supported only at the front edge 14D.

The housing 1 is connected with the mating housing to connect the male tab and the terminal fitting 3. The male tab is inserted into the main portion 6 through the male-tab insertion hole 4A from the front. The male tab begins resiliently deforming the tongue 14 down in a deformation direction when the leading end of the male tab is about to touch the contact point 14A of the tongue 14. Thus, the tab is sandwiched resiliently between the contact point 14A and the contact projection 6D to be kept in a contact state.

As described above, the front end surface 5C of the locking projection 5B can be located before the extending end 14C of the tongue 14 and the rear end of the slant surface 5D of the locking projection 5B can be located behind the extending end 14C of the tongue 14 by locating the extending end 14C of the tongue 14 more inwardly than the locking projection 5B. Thus, the dimension in forward and backward directions of a portion of the locking projection 5B receiving the shear force from the front edge 12A of the locking hole 12 can be extended. As a result, the sectional area against the shear force can be enlarged. Therefore, the holding force to prevent the terminal fitting 3 from coming out backward is enhanced while the terminal fitting 3 is miniaturized. The supports 15 are above the bottom wall 6A and can engage the extending end 14C of the tongue 14 to prevent interference between the locking projection 5B and the tongue 14 at least during the connection with the male tab. Hence, the tongue 14 is supported at two points, i.e. at the front edge 14D and at the extending end 14C, and connection reliability is improved by strengthening the contact pressure with the male tab as compared to a case where the tongue 14 is supported at one point. Further, the support 15 can be provided easily and inexpensively by cutting and bending parts of the side walls 6B above lateral edges of the bottom wall 6A. The two supports 15 are spaced apart in the width direction WD, and support the tongue 14 in a stable posture without twisting.

In addition, the first preventing portion 16A is formed to share the structural portion of the stabilizer 17, which contributes to the miniaturization of the terminal fitting 3 and ensures a location for another functional part to increase a degree of freedom in design. Further, the edges of the slits serve as the preventing portion 16A and can be flat to prevent excessive deformation of the tongue 14 more stably. Furthermore, the stabilizer 17 can bulge out farther to improve the erroneous insertion preventing function.

Figure 13:
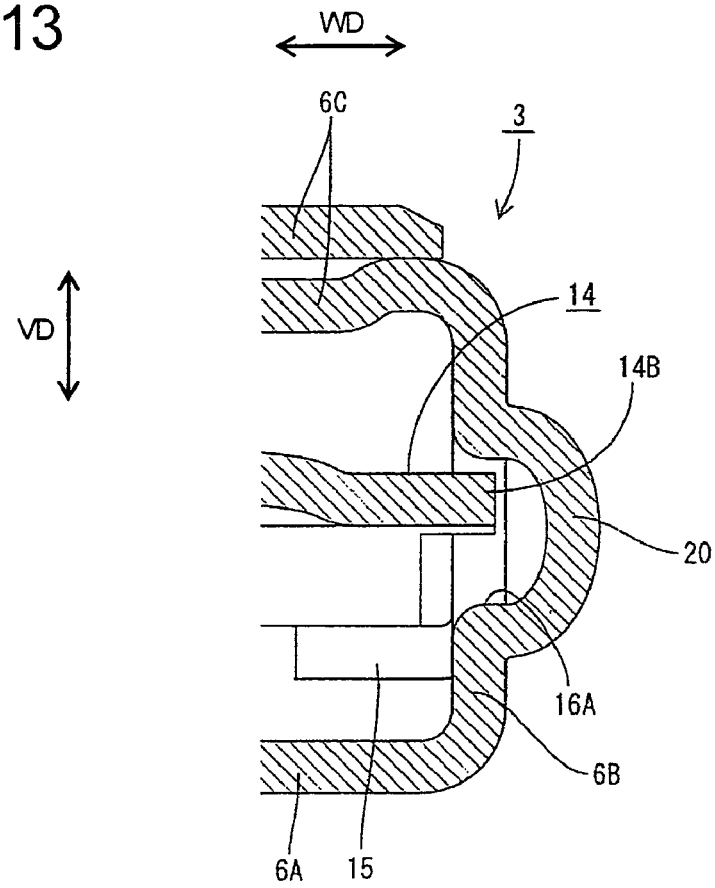
FIG. 13 is a vertical section showing a stabilizer according to a second embodiment.
Figure 14:
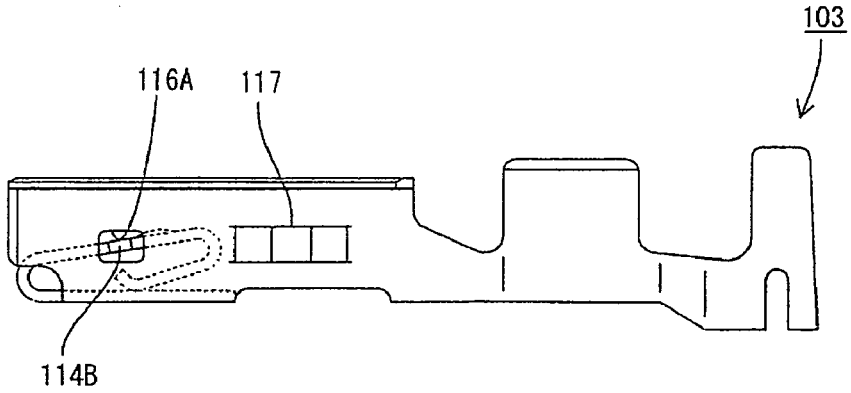
FIG. 14 is a side view showing a terminal fitting in which a stabilizer and preventing portions are separately provided.

A second embodiment of the invention is described with reference to FIG. 13. A connector of this embodiment is obtained by changing the construction of the stabilizer 17 of the terminal fitting 3 of the first embodiment, and other similar constructions are not described. A stabilizer 20 of the second embodiment is embossed to project out without forming a slit. A first preventing portion 16A engages the preventing piece 14B when the tongue 14 is deformed in the vertical direction VD within its resiliency limit, and prevents the tongue 14 from being deformed excessively. In this way, no openings are made in the side wall 6B of the terminal fitting 3, and the stabilizer 20 is formed while leaving the side wall 6*b* closed. Thus entry of external matter can be avoided.

Figure 15:
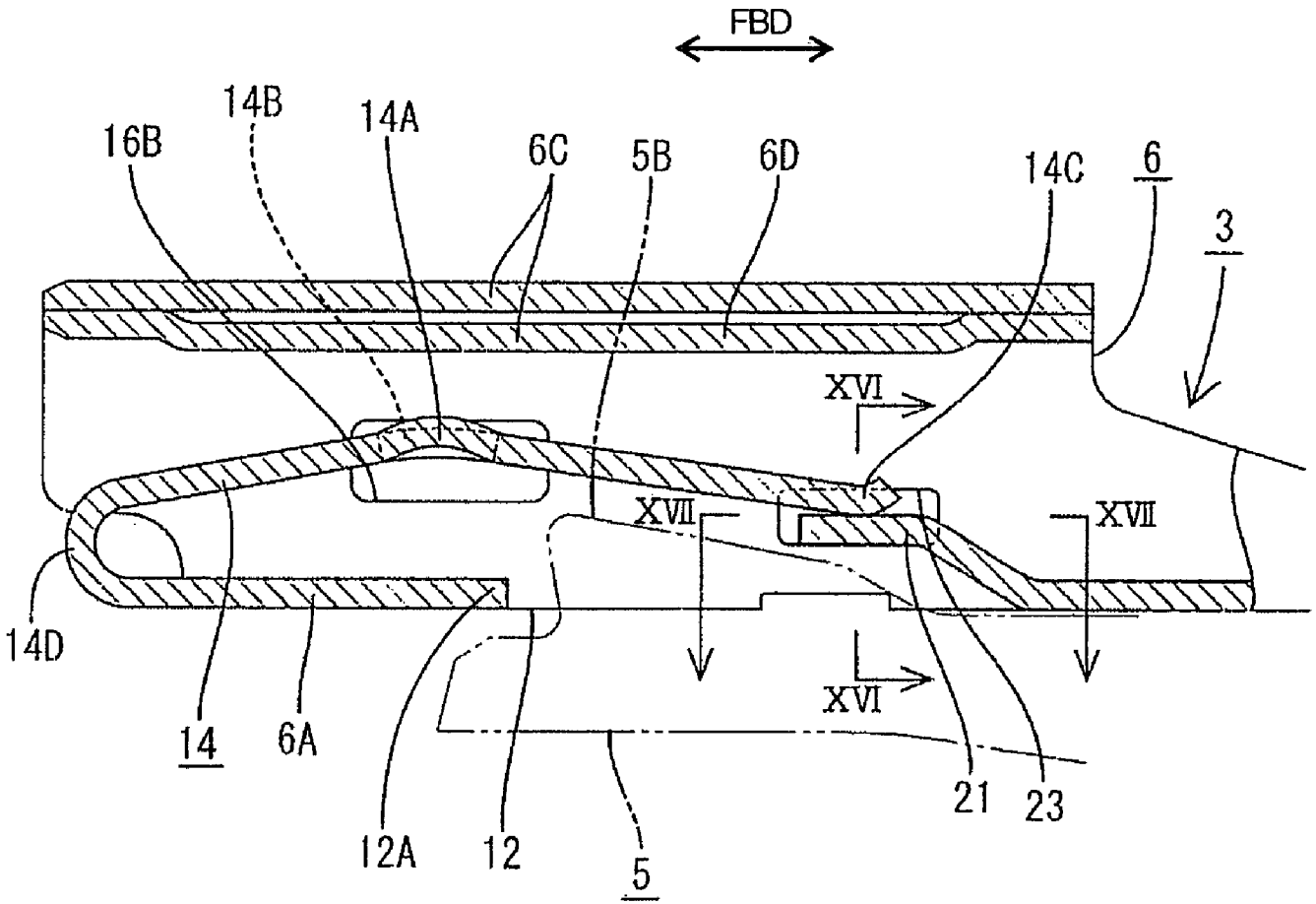
FIG. 15 is a longitudinal section showing a supporting surface according to a third embodiment.
Figure 16:
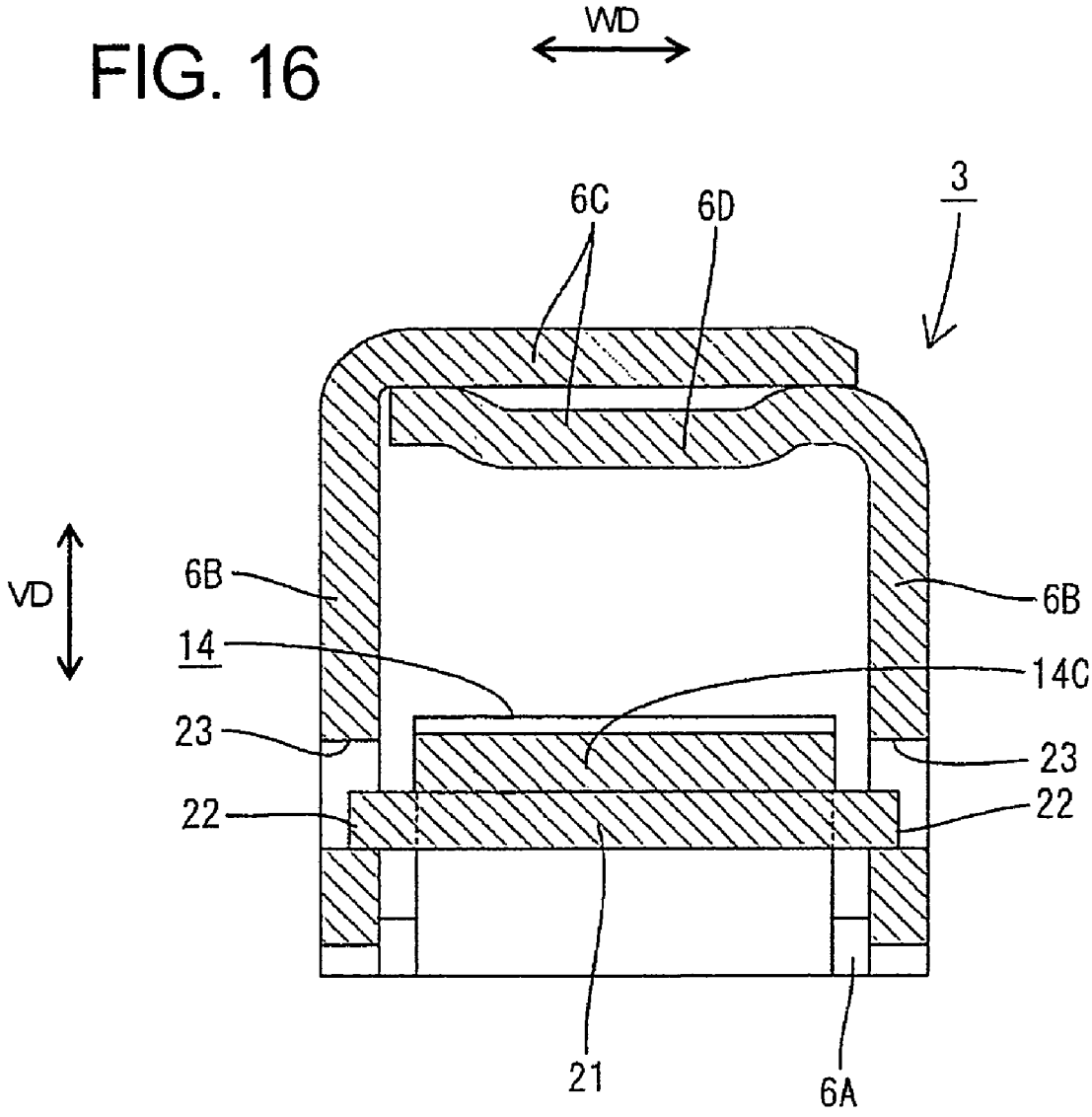
FIG. 16 is a section along XVI-XVI of FIG. 15.
Figure 17:
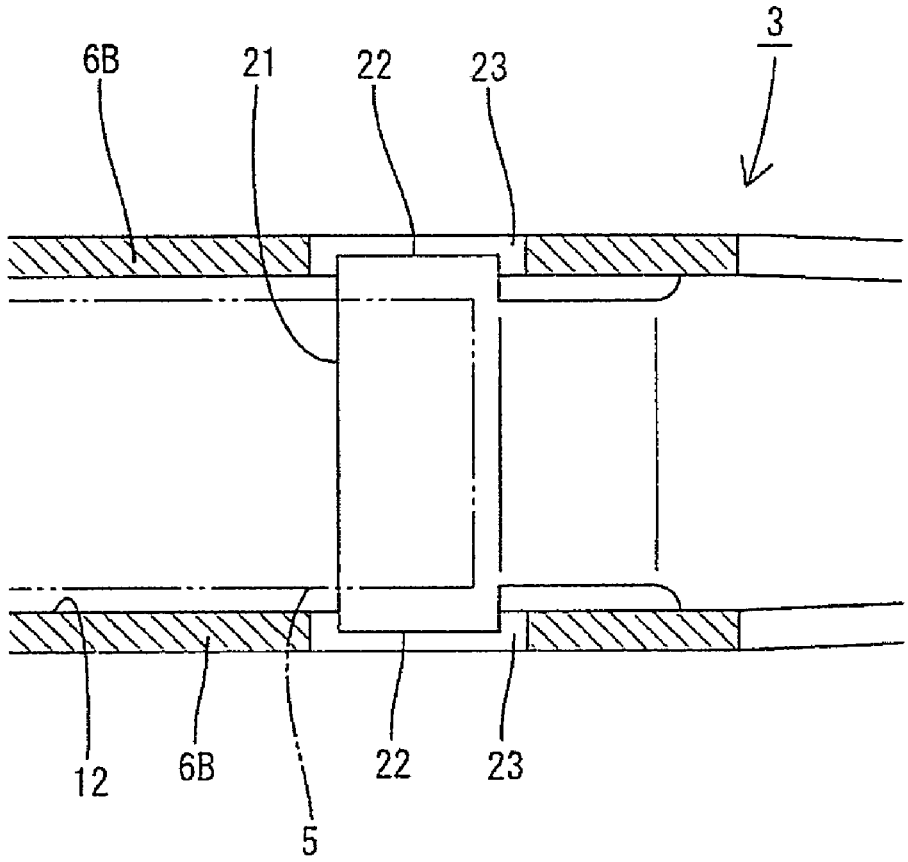
FIG. 17 is a section along XVII-XVII of FIG. 15.

A third embodiment of the invention is described with reference to FIGS. 15 to 17. The connector of this embodiment has a terminal fitting 3 with supports 15 that differ from the supports of the first embodiment. Other parts of the connector, however, are substantially the same, and are not described. Specifically, the supports 15 of the first embodiment are formed by bending lower parts of the side walls 6B inward. However, a support 21 of this embodiment is formed by forming two slits extending back from the opposite widthwise edges of the locking hole 12 and bending a portion between the slits inward of the main portion 6. An opening left in the bottom wall 6A by the above bending forms part of the locking hole 12. The bent portion has a slanted panel sloped up towards the front from the bottom wall 6A and the support 21 extends substantially horizontally forward from the front edge of the slanted panel. Two supporting projections 22 bulge out from the opposite widthwise edges of the support 21, and receiving portions 23 are formed in the opposite side walls 6B at positions facing the corresponding supporting projections 22. The supporting projections 22 are engageable with the opening edges of the receiving portions 23. By this arrangement, displacement of the support 21 can be prevented even if the support 21 receives a force from the extending end 14C of the tongue 14. Therefore, the tongue 14 can be supported securely.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The extending end 14C is substantially constantly in contact with the supporting surfaces 15 in the foregoing embodiments. However, it may not be in contact therewith in a natural state where no force acts and may be supported thereon as the male tab is inserted.

The tongue 14 is extended back so that the extending end 14C is supported on the supports 15. However, it may be extended farther back.

The extending end 14C is supported on the supports 15 after the connection with the male tab in the foregoing embodiments. However, the supports 15 may be omitted.

The main portion 6 is a rectangular tube in the foregoing embodiments. However, it may have another tubular shape, e.g. a hollow cylindrical shape or elliptical tubular shape or any polygonal shape.

The second preventing portion 16B may be formed differently provided that it is engageable with the preventing piece 14B. For example, a part of the side wall 6B may be embossed in to form the second preventing portion 16B for engaging with the preventing piece 14B without boring.

The preventing portions 16 and the preventing pieces 14B are spaced apart in the width direction WD in the foregoing embodiments. However, the preventing portions 16 and the preventing pieces 14B need not be in pairs provided that they can prevent excessive deformation of the tongue 14.

What is claimed is:

1. A connector comprising a housing having opposite front and rear ends, at least one cavity penetrating the housing in forward and backward directions, a lock at least partly in the cavity, at least one terminal fitting accommodated in the cavity, the terminal fitting having opposite front and rear ends, a tubular main portion adjacent the front end of the terminal fitting and a locking hole formed in a wall of the main portion rearward of the front end of the terminal fitting, the lock including a locking projection defining a portion of the lock that is inserted through the locking hole and into the main portion, the locking projection having a front end for engaging an edge of the wall defining the locking hole, the locking protection further having a rear end rearward of the front end, and a resiliently deformable tongue extending from the wall substantially at the front end of the terminal fitting and being folded back into the main portion, the tongue having a contact point for contacting a tab inserted in the main portion, the tongue further having an extending end defining a part of the tongue farthest from the front end of the terminal fitting, the extending end of the tongue being behind the contact point and inward from at least portions of the locking projection, the front end of the locking projection being between the extending end and the front end of the terminal fitting, the rear end of the locking projection being between the extending end and the rear end of the terminal fitting.

2. The connector of claim 1, wherein the terminal fitting has at least one support above the wall and supporting the extending end at least when the male tab contacts the contact point.

3. The connector of claim 2, wherein the support is formed by bending an area of the main portion inward.

4. The connector of claim 2, wherein two supports are provided and are spaced apart in a width direction.

5. The connector of claim 2, wherein the support is cantilevered from the wall of the main portion, and an opening left in the wall by forming the support communicates with the locking hole.

6. The connector of claim 2, wherein a supporting projection bulges out sideways from at least one widthwise edge of the support, a receiving portion being provided on a side wall of the main portion facing the supporting projection, and the supporting projection being engageable with the receiving portion.

7. The connector of claim 1, wherein the lock comprises a base and a locking projection projecting from an inner surface of the base.

8. The connector of claim 7, wherein the locking projection is substantially fully in the locking hole of the terminal fitting when the lock locks the terminal fitting, so that a reference plane between the base and the locking projection is substantially flush with a plane of opening of the locking hole when the lock engages the terminal fitting.

9. The connector of claim 1, wherein the tongue is supported at two longitudinally spaced positions at least when the tongue is deformed.

10. The connector of claim 1 wherein at least one projection bulges out from at least one edge of the tongue, at least one preventing portion formed at a side wall of the main portion facing the projection and being engageable with the projection, the projection being engageable with the preventing portion to prevent an excessive deformation of the tongue.

* * * * *